US006622469B2

(12) United States Patent
Günster et al.

(10) Patent No.: US 6,622,469 B2
(45) Date of Patent: Sep. 23, 2003

(54) WRISTBAND WITH ARTICULATED LINKS

(75) Inventors: Armin Günster, Lengnau (CH); Michael Bach, Biel (CH); Sébastien Bolzt, Moutier (CH); Christophe Guerry, Oberbuchsiten (CH)

(73) Assignee: Montres Rado S.A., Lengnau (CH)

( * ) Notice: Subject to any disclaimer, the term of this patent is extended or adjusted under 35 U.S.C. 154(b) by 92 days.

(21) Appl. No.: 09/927,260

(22) Filed: Aug. 13, 2001

(65) Prior Publication Data

US 2002/0020726 A1 Feb. 21, 2002

(30) Foreign Application Priority Data

Aug. 11, 2000 (CH) ..... 1564/00

(51) Int. Cl.[7] ..... F16G 15/04
(52) U.S. Cl. ..... 59/80; 59/83; 63/4
(58) Field of Search ..... 59/80, 83; 63/4, 63/5.1

(56) References Cited

U.S. PATENT DOCUMENTS

| | | | | | |
|---|---|---|---|---|---|
| 3,363,745 | A | * | 1/1968 | Thuerman et al. | 59/80 |
| 3,837,163 | A | * | 9/1974 | Fujimori | 59/80 |
| 5,197,274 | A | * | 3/1993 | Braun | 59/80 |
| 6,098,394 | A | * | 8/2000 | Hashimoto et al. | 59/82 |

FOREIGN PATENT DOCUMENTS

| | | |
|---|---|---|
| EP | 184 697 | 6/1986 |
| EP | 229 908 | 7/1987 |
| FR | 2 627 677 | 9/1989 |
| FR | 2 727 168 | 5/1996 |

* cited by examiner

*Primary Examiner*—David Jones
(74) *Attorney, Agent, or Firm*—Sughrue Mion, PLLC

(57) ABSTRACT

The wristband with links (2, 3, 4) includes a plurality of bars (5) acting as means for linking and articulating the links with each other and means for holding said bars in said links. Each bar is held axially by at least one of its ends (13) on to a link (2) by means of a collared sleeve (6) designed and arranged to abut against holding means (7, 8) carried both by the bar and the link.

5 Claims, 2 Drawing Sheets

WRISTBAND WITH ARTICULATED LINKS

The present invention relates to a wristband with links including a plurality of bars acting as connection and articulation means between the links and means for holding said bars in said links.

A multitude of versions of wristbands with links using bars acting as connection and articulation means between the links are known, as are a multitude of embodiments showing how these bars are held in the links.

When metal links are used, bars driven into holes made in the links are often used. This method is not possible if the links are made of a friable and brittle material, for example ceramics. Indeed, it will be understood that driving in bars may cause a brittle material to shatter.

In order to get round this difficulty, wristbands have been proposed (see for example, Swiss Patent document No. 600 815) including an inner chain made of steel and bearing all the mechanical stress, this inner chain being covered by decorative links which are strong or are threaded onto the inner chain. This solution has the drawback of being complex and having a high cost price.

In order to overcome the drawbacks of the solutions proposed above, European Patent document No. 0 950 364 proposes a bar at least one end of which is slit, this end being arranged to co-operate with a blocking part penetrating the slit of said end and thus securing the bar to the link. This latter solution has the drawback of requiring a blocking part which is welded, bonded or driven into the link to prevent any inadvertent dislocation of the wristband.

The aforecited drawbacks are avoided if the teaching of the present invention is implemented, according to which each bar is held axially by at least one of its ends onto a link by means of a sleeve with a collar designed and arranged to abut against holding means carried both by the bar and by the link.

The present invention is also original as regards the method for assembling the different elements constituting the wristband, such method being described in detail hereinafter.

The features and advantages of the invention will appear now in the following description, made with reference to the annexed drawings and giving, by way of non-limiting explanatory example, several advantageous embodiments of the invention, in such drawings.

Figures 1, 2, 3:
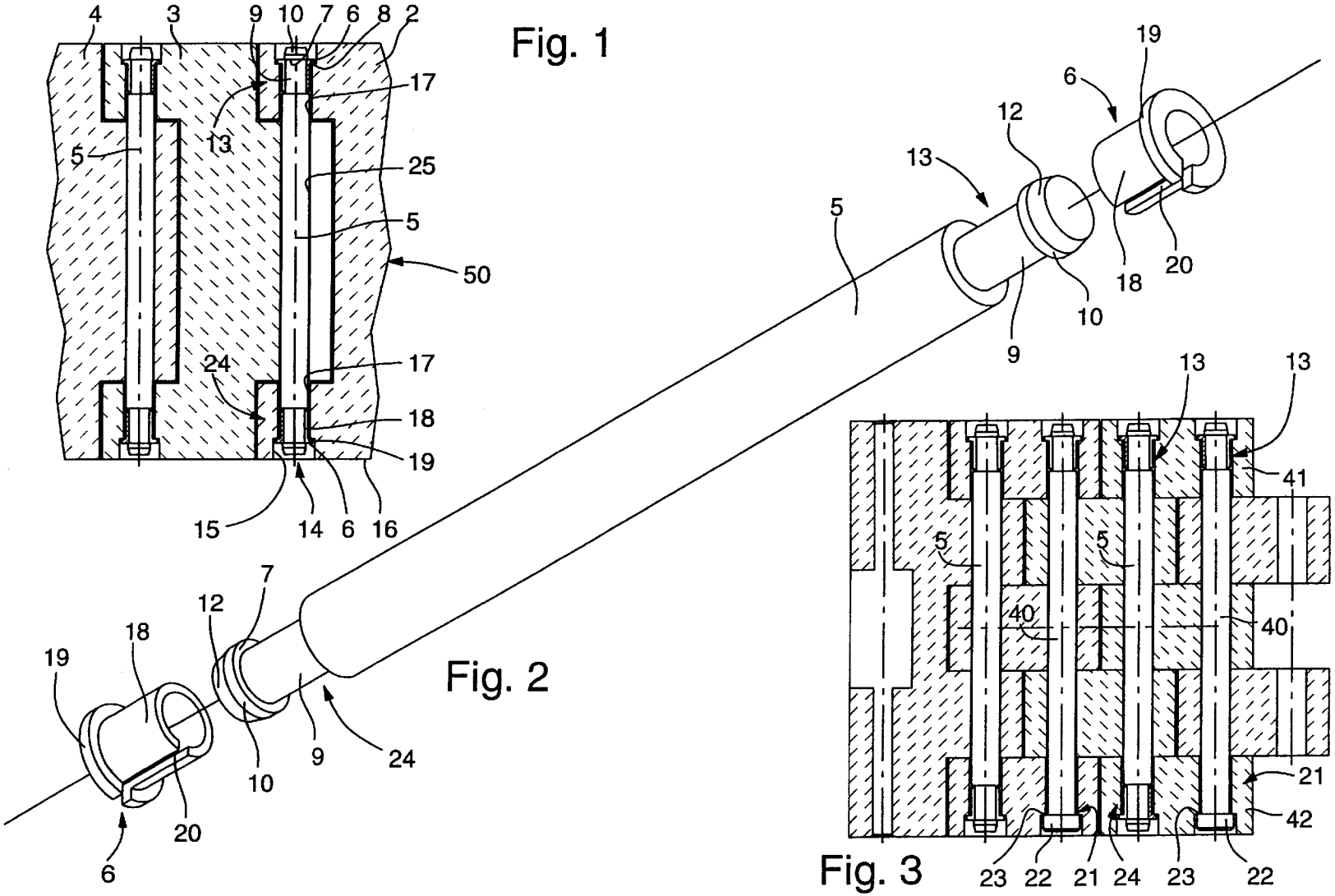
FIG. 1 is a plan cross-section of a first embodiment of the invention.
FIG. 2 is a perspective view of the bar used in FIG. 1; figure in which sleeves with a collar subject of the invention have also been shown in perspective.
FIG. 3 is a plan cross-section of a second embodiment of the invention.

A first embodiment of the invention is shown in FIG. 1. Here the wristband includes only one row of links 50, of which only three links referenced 2, 3 and 4 are shown. As FIG. 1 shows, two successive links, for example links 2 and 3, are linked and articulated one after the other by means of a bar 5. This bar 5 is housed in three aligned holes, namely holes 17 of link 2 aligned with hole 25 of link 3. FIG. 1 shows the means for holding bar 5 axially in link 2 consisting, according to a feature of the present invention, of a sleeve 6 with a collar (shown in cross-section in FIG. 1 and in perspective in FIG. 2) disposed at each end 13 and 24 of the bar, this collared sleeve 6 being designed and disposed to abut against holding means 7 and 8 carried both by bar 5 and by link 2, one embodiment of these holding means being explained now.

Figure 4:
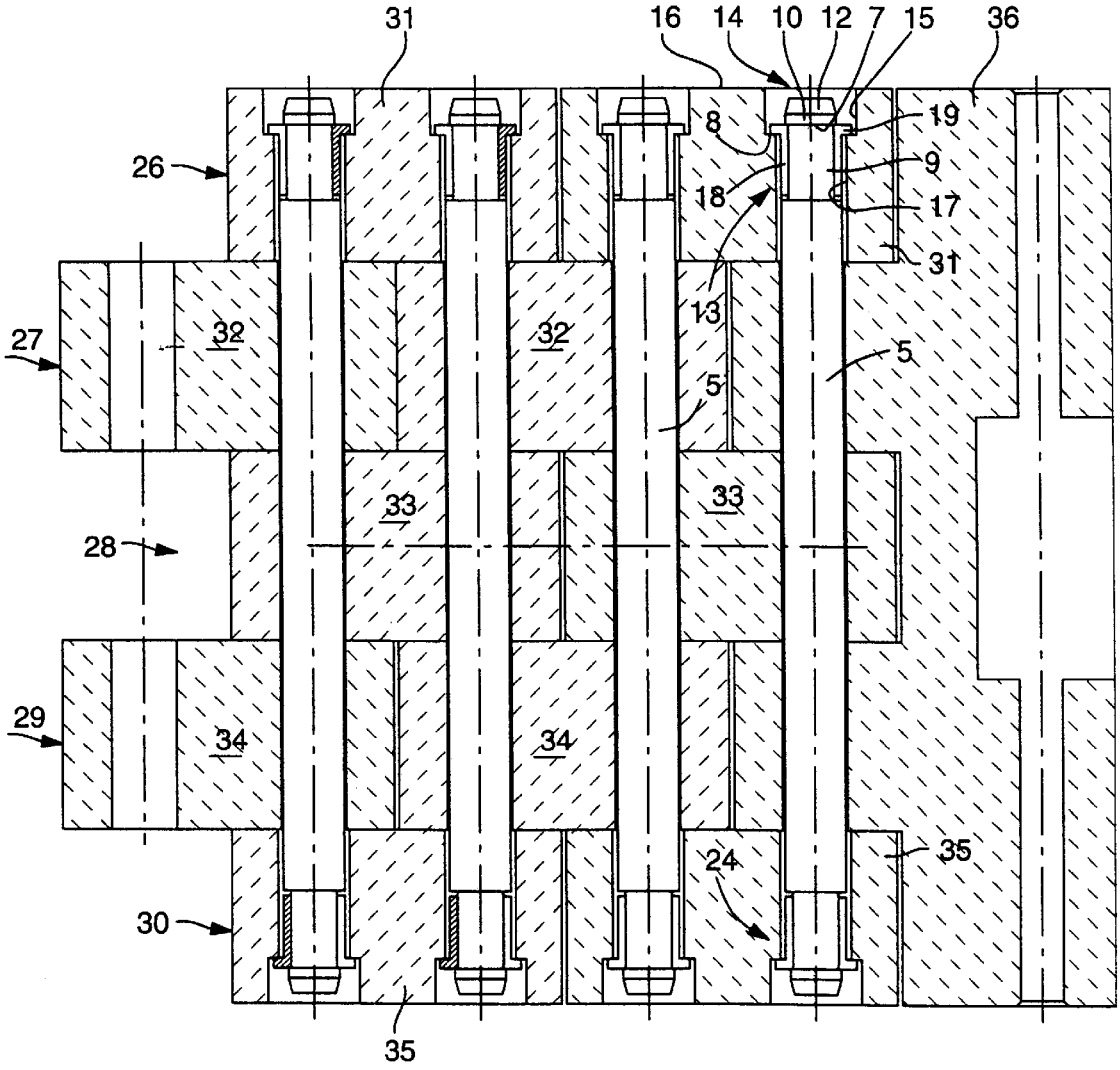
FIG. 4 is a plan cross-section of a third embodiment of the invention.

FIGS. 1 and 2 show that bar 5 includes at each of its ends 13 and 24 a cylindrical groove 9 which precedes a head 10. Head 10 has a lower shoulder 7 and a truncated top 12. Each end 13 and 24 of bar 5 is engaged in a housing 14 made in link 2. This housing 14 has a first hole 15 which opens onto a wall 16 of link 2, this first hole 15 being followed by a second hole 17 of smaller diameter than the first. As is seen in FIG. 1, and perhaps better still in FIG. 4 which is drawn on a larger scale, first and second holes 15 and 17 form a shoulder 8. The same Figures also show that a sleeve 6 with a shoulder is housed between cylindrical groove 9 of bar 5 and the inner wall of second hole 17, this sleeve 16 being made integral with a cylindrical body 18 and a collar 19. FIGS. 1 and 4 show finally that collar 19 is sandwiched between shoulder 8 formed by first and second holes 15 and 17 and lower shoulder 7 of head 10 to hold bar 5 axially either in link 2 of FIG. 1, or in link 31 of FIG. 4. Sleeve 6 with a collar has, over its entire length, a slit 20 the function of which will be explained hereinbelow when the method for assembling the wristband is discussed.

As was seen above, a collared sleeve 6 is disposed at each of ends 13 and 24 of bar 5 to immobilise the latter.

In FIG. 1, these ends 13 and 24 are housed at both ends of a same link 2 and the same bar 5 passes through hole 25 of link 3 to link and articulate link 2 onto link 3. The same is true for links 3 and 4.

With reference now to FIG. 4, it can be seen that ends 13 and 24 of bar 5 are each capped with a collared sleeve 6. The ends are respectively housed in first and second lateral links 31 and 35 of a wristband which further includes, per assembly pitch three central links 32, 33 and 34, central links 32 and 34 in contact with lateral links 31 and 35 being offset by half a pitch to form thus a wristband including five rows of links, namely two rows 26 and 30 of lateral links and three rows 27, 28 and 29 of central links. As is seen in FIG. 4, the end of the wristband may include a link 36 in a single piece, acting for example as a junction element for a clasp.

FIG. 3 shows that the collared sleeve 6 can only be arranged at a first end of the bar. This is the case of bar 40 of FIG. 3 where first end 13 is capped with a collared sleeve according to the invention, the second end 21 of bar 40 having a head 22 abutting against a second shoulder 23 of link 42. This arrangement for the second end 21 has already been explained in the aforecited European Patent document No 0 959 364.

It will also be noted, as regards FIG. 3, that bars 5 provided with a collared sleeve at each of their ends are alternated with bars 40 provided with a collared sleeve at only one end, a variant of this arrangement being able to consist in arranging bars 40 head-to-tail. It will further be noted that the wristband of FIG. 3 is manufactured in the same way as that of FIG. 4 since it is provided with five rows of links. However, the alternation of bars 5 and 40 could of course be applied to the wristband of FIG. 1 which includes only a single row 50 of links, this alternation of bars being essentially dictated by an improved aesthetic appearance of the lateral sides of the wristband.

The idea of holding a bar axially by means of a collared sleeve arises above all from the desire to avoid subjecting the link to excessive mechanical stress which could damage it and even cause it to shatter if the bar was held by being driven into a brittle and/or hard material such as ceramics, a hard metal, PCD diamond (polycrystalline diamond), or CVD diamond. As appears from the preceding description, the links do not require any particular machining, such as a threading and may advantageously be made of a sintered ceramic material using as a starting material a ceramic powder compressed in a mould to form a blank which is then sintered to assure cohesion of the powder.

This description will end with an explanation of a method for assembling the wristband, for example the wristband shown in FIG. 1.

One begins by providing a bar 5 (see FIG. 2) arranged to accommodate at each of its ends 13 and 24 a collared sleeve 6. On the first end 13 of this bar, a first collared sleeve is mounted forcing this collared sleeve to pass over head 10. Since the diameter of head 10 is greater than the inner bore of the collared sleeve, a slit 20 has been made therein over its entire length which allows the collared sleeve to spread out when it passes over the head. It will be noted that the introduction of collared sleeve 6 over head 10 is facilitated by a top 12 of head 10 which is truncated. Finally the collared sleeve takes its place in cylindrical groove 9 of bar 5 after passing over head 10. Since cylindrical groove 9 has a slightly greater diameter than the inner bore of collared sleeve 6, the securely clamping of one part onto the other is thus ensured.

Bar 5 is then introduced by its free end 24 into lined up holes 17 and 25 of the two assembled links 2 and 3.

Finally a second collared sleeve 6 is mounted on second end 24 of bar 5 in the same way as described with reference to the first collared sleeve mounted on first end 13 of the bar. Once this assembly is finished, each of the collars 19 of the first and second collared sleeves 6 is then sandwiched between shoulder 8 formed by first and second holes 15 and 17 made in link 2 and lower shoulder 7 of head 10, which holds bar 5 axially in link 2.

The same assembly method is implemented to assemble a wristband with several rows of links, for example the wristband shown in FIG. 4. In this case the first end 13 of bar 5 is held by a first collared sleeve in a first lateral link 31 and the second end 24 of bar 5 is held by a second collared sleeve in a second lateral link 35, while the same bar 5 passes through central links 32, 33 and 34.

With respect both to the number of parts involved in its composition and to its assembly method, the wristband using the collared sleeve of the invention is very advantageous as regards its cost price, whether it includes a single row of links or several such rows.

One may however wonder whether collared sleeve 6 of the invention could be reduced to a single collar 19 without the sleeve 18. Trials made by the Applicant have shown that a single washer does not provide a sufficient hold and proper centring of the bar in the link, and consequently the remaining washer quickly deteriorates eventually leading to dislocation of the wristband.

What is claimed is:

1. A wristband having links made of a hard material and including a plurality of bars acting as connection and articulation means between the links and means for holding said bars in said links, wherein each bar includes, at least at one of its ends, a cylindrical groove preceding a head having a lower shoulder and a truncated top, this end being engaged in a housing made in the link, this housing having a first hole opening onto an outer wall of the link, this first hole being followed by a second hole of smaller diameter than the first to form a shoulder, and in that a sleeve is housed between the cylindrical groove and the inner wall of the second hole, this sleeve being made in a single piece with a collar to form a collared sleeve, the collar being sandwiched between the shoulder formed by the first and second holes and the lower shoulder of the head to hold the bar axially in the link, the collared sleeve having a slit over its entire length.

2. A wristband according to claim 1, wherein a collared sleeve (6) is arranged at both ends of the bar.

3. Wristband according to claim 1, wherein a collared sleeve is arranged at a first end of the bar, the second end of said bar having a head abutting against a shoulder of the link.

4. A wristband according to claim 1, wherein the hard material is selected from the group consisting of a ceramic material, a hard metal, PCD diamond (polycrystalline diamond) and CVD diamond.

5. A method for assembling a wristband having links made of a hard material and including a plurality of bars acting as connection and articulation means between the links and means for holding said bars in said links, wherein each bar includes, at least at one of its ends, a cylindrical groove preceding a head having a lower shoulder and a truncated top, this end being engaged in a housing made in the link, this housing having a first hole opening onto an outer wall of the link, this first hole being followed by a second hole of smaller diameter than the first to form a shoulder, and in that a sleeve is housed between the cylindrical groove and the inner wall of the second hole, this sleeve being made in a single piece with a collar to form a collared sleeve, the collar being sandwiched between the shoulder formed by the first and second holes and the lower shoulder of the head to hold the bar axially in the link, the collared sleeve having a slit over its entire length, wherein said method includes the following succession of steps:

mounting on a first end of one of said bars a first collared sleeve forcing the latter to pass over the head of the bar until it takes its place in the cylindrical groove of said bar, the slit of the collared sleeve allowing said collared sleeve to spread out when it passes over the head and then to grip said cylindrical groove;

introducing the bar via a free end thereof into the lined up holes of at least two assembled links; and mounting a second collared sleeve on a second end of the bar in the same way as described with reference to the first collared sleeve, each of the collars of the first and second collared sleeves then being sandwiched between the shoulder formed by the first and second holes made in the link and the lower shoulder of the head to hold the bar axially in the link.

* * * * *